US011746796B1

(12) United States Patent
Petrus et al.

(10) Patent No.: US 11,746,796 B1
(45) Date of Patent: Sep. 5, 2023

(54) PLENUM FAN WITH TELESCOPING BLADES

(71) Applicant: SmithGroup Companies, Inc., Detroit, MI (US)

(72) Inventors: Ionel Petrus, Silver Spring, MD (US); Elena Gowdy Charming, Arlington, VA (US)

(73) Assignee: SMITHGROUP COMPANIES, INC., Detroit, MI (US)

( * ) Notice: Subject to any disclaimer, the term of this patent is extended or adjusted under 35 U.S.C. 154(b) by 0 days.

(21) Appl. No.: 18/054,331

(22) Filed: Nov. 10, 2022

(51) Int. Cl.
*F04D 29/30* (2006.01)
*F04D 29/28* (2006.01)
*F04D 17/16* (2006.01)

(52) U.S. Cl.
CPC ..... *F04D 29/30* (2013.01); *F04D 17/16* (2013.01); *F04D 29/281* (2013.01)

(58) Field of Classification Search
CPC ..... F04D 15/0038; F04D 15/0055; F04D 27/0002; F04D 27/0246
See application file for complete search history.

(56) References Cited

U.S. PATENT DOCUMENTS

| | | | | |
|---|---|---|---|---|
| 4,049,363 | A | 9/1977 | Baumann et al. | |
| 4,618,313 | A | 10/1986 | Mosiewicz | |
| 5,207,557 | A | 5/1993 | Smiley, III et al. | |
| 6,972,956 | B2 | 12/2005 | Franz et al. | |
| 8,152,466 | B2 * | 4/2012 | Gandhi | B64C 27/46 416/88 |
| 10,094,454 | B2 * | 10/2018 | Russalian | F16H 25/00 |

FOREIGN PATENT DOCUMENTS

| | | | | |
|---|---|---|---|---|
| CN | 202500822 U | | 10/2012 | |
| CN | 203560156 U | | 4/2014 | |
| CN | 113969900 A | * | 1/2022 | |
| EP | 1801422 A2 | | 2/2006 | |
| WO | WO-2014005171 A1 | * | 1/2014 | F04D 19/002 |

* cited by examiner

*Primary Examiner* — Courtney D Heinle
*Assistant Examiner* — Danielle M. Christensen
(74) *Attorney, Agent, or Firm* — Brooks Kushman P.C.

(57) ABSTRACT

A fan wheel includes a pair of opposing parallel plates that rotate about an axis, one of the plates moves toward and away from the other of the plates along the axis. The fan wheel also includes a plurality of telescoping fan blades having opposite ends respectively mounted to the plates such that the one of the plates moves away from the other of the plates as the telescoping fan blades extend and the one of the plates moves toward the other of the plates as the telescoping fan blades retract.

13 Claims, 3 Drawing Sheets

PLENUM FAN WITH TELESCOPING BLADES

TECHNICAL FIELD

This disclosure generally relates to heating, ventilation, and air conditioning equipment for buildings.

BACKGROUND

Industrial buildings typically include various equipment to maintain interior conditions within predefined ranges. This equipment may generate and supply warm air during cold weather, and generate and supply cool air during hot weather. Fans may be used to move this air throughout ducts within the buildings.

SUMMARY

A fan includes a housing defining a gas outlet for the fan, and a pair of opposing parallel plates disposed within the housing and being able to rotate about an axis. One of the plates moves toward and away from the other of the plates along the axis. The fan also includes a plurality of first fan blades fixedly secured to and extending perpendicularly from a face of one of the plates, and a plurality of second fan blades fixedly secured to and extending perpendicularly from a face of the other of the plates. The faces are adjacent to each other. Each of the second fan blades receives a corresponding one of the first fan blades as the one of the plates moves toward the other of the plates. The second fan blades are arranged to surround a gas inlet for the fan that is in fluid communication with the gas outlet.

A fan wheel includes a pair of opposing parallel plates that rotate about an axis. One of the plates moves toward and away from the other of the plates along the axis. The fan wheel also includes a plurality of telescoping fan blades having opposite ends respectively mounted to the plates such that the one of the plates moves away from the other of the plates as the telescoping fan blades extend and the one of the plates moves toward the other of the plates as the telescoping fan blades retract.

A method for controlling a fan includes generating commands for at least one motor arranged to drive a worm gear having a threaded shaft connecting opposite parallel plates of a fan wheel that have telescoping fan blades connected therebetween such that one of the plates moves toward the other of the plates to cause the telescoping fan blades to retract.

BRIEF DESCRIPTION OF THE DRAWINGS

In the following detailed description, reference is made to the accompanying figures, which form a part thereof, and in which are shown by way of illustration specific embodiments. Other embodiments, of course, are also contemplated and/or described.

DETAILED DESCRIPTION

Embodiments are described herein. It is to be understood, however, that the disclosed embodiments are merely examples and other embodiments may take various and alternative forms. The figures are not necessarily to scale. Some features could be exaggerated or minimized to show details of particular components. Therefore, specific structural and functional details disclosed herein are not to be interpreted as limiting, but merely as a representative basis for teaching one skilled in the art.

Various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
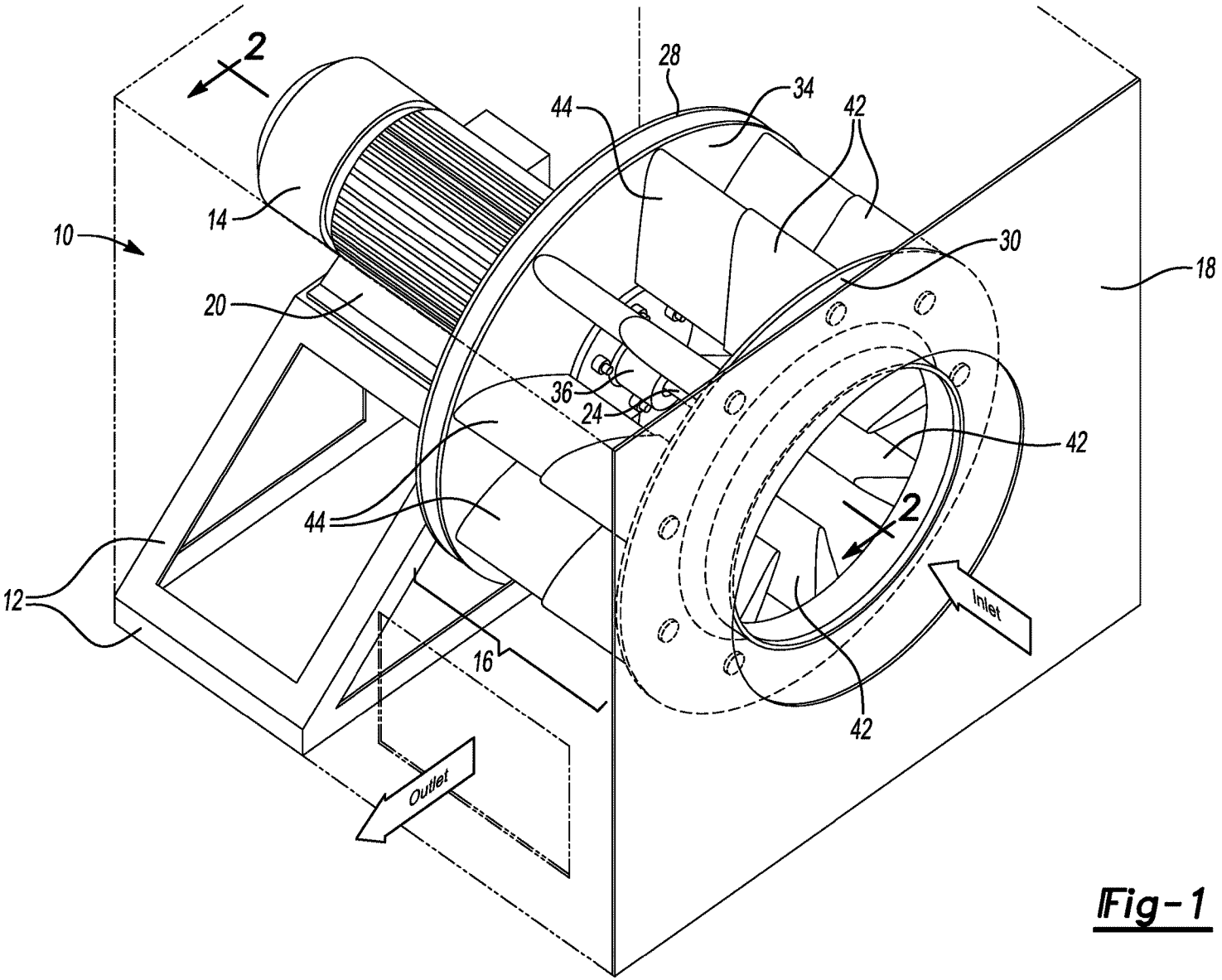
FIG. 1 is a perspective view of an example centrifugal fan arrangement.
Figure 2:
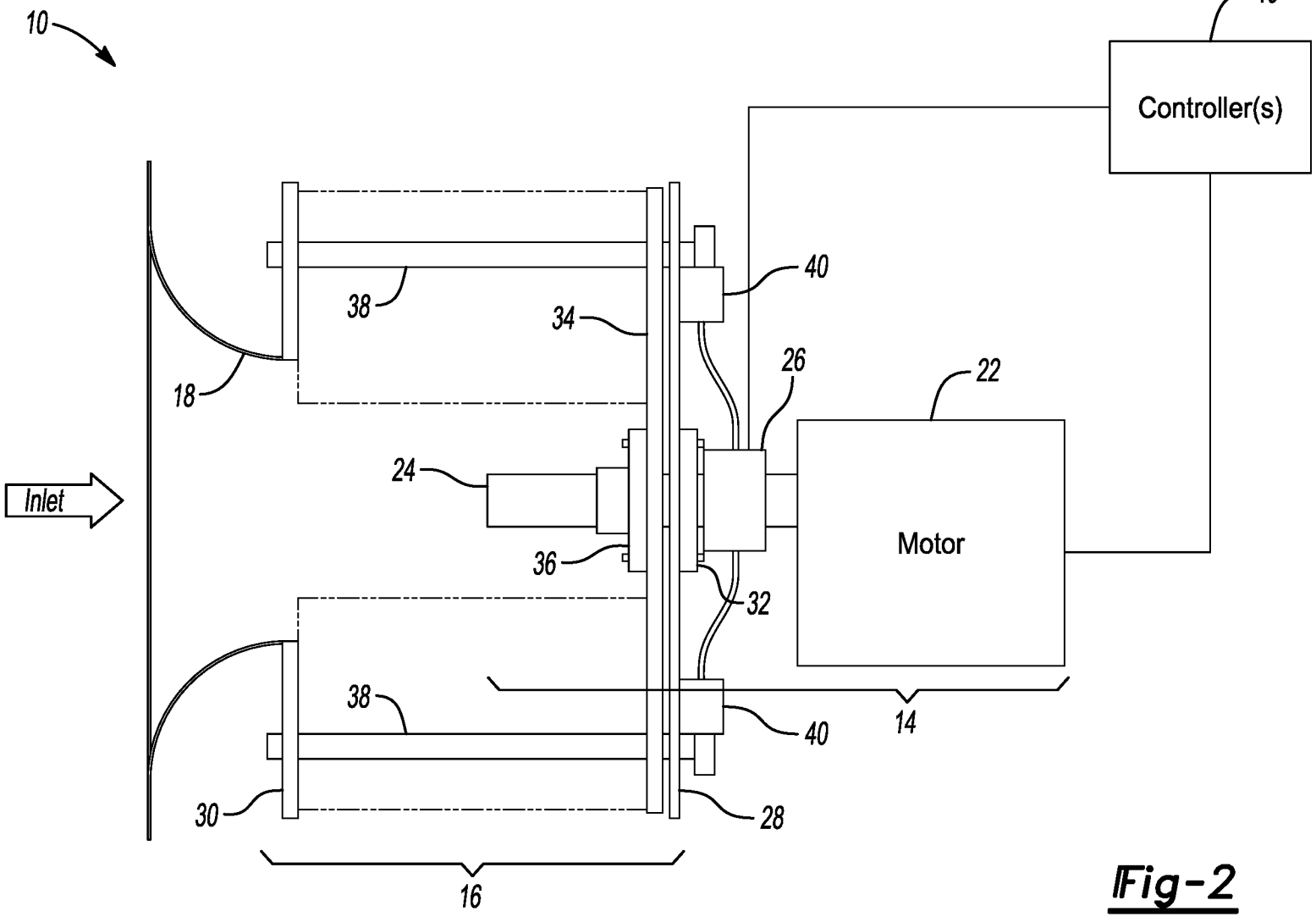
FIG. 2 is a schematic view in cross-section of portions of the centrifugal fan arrangement of FIG. 1.
Figure 3:
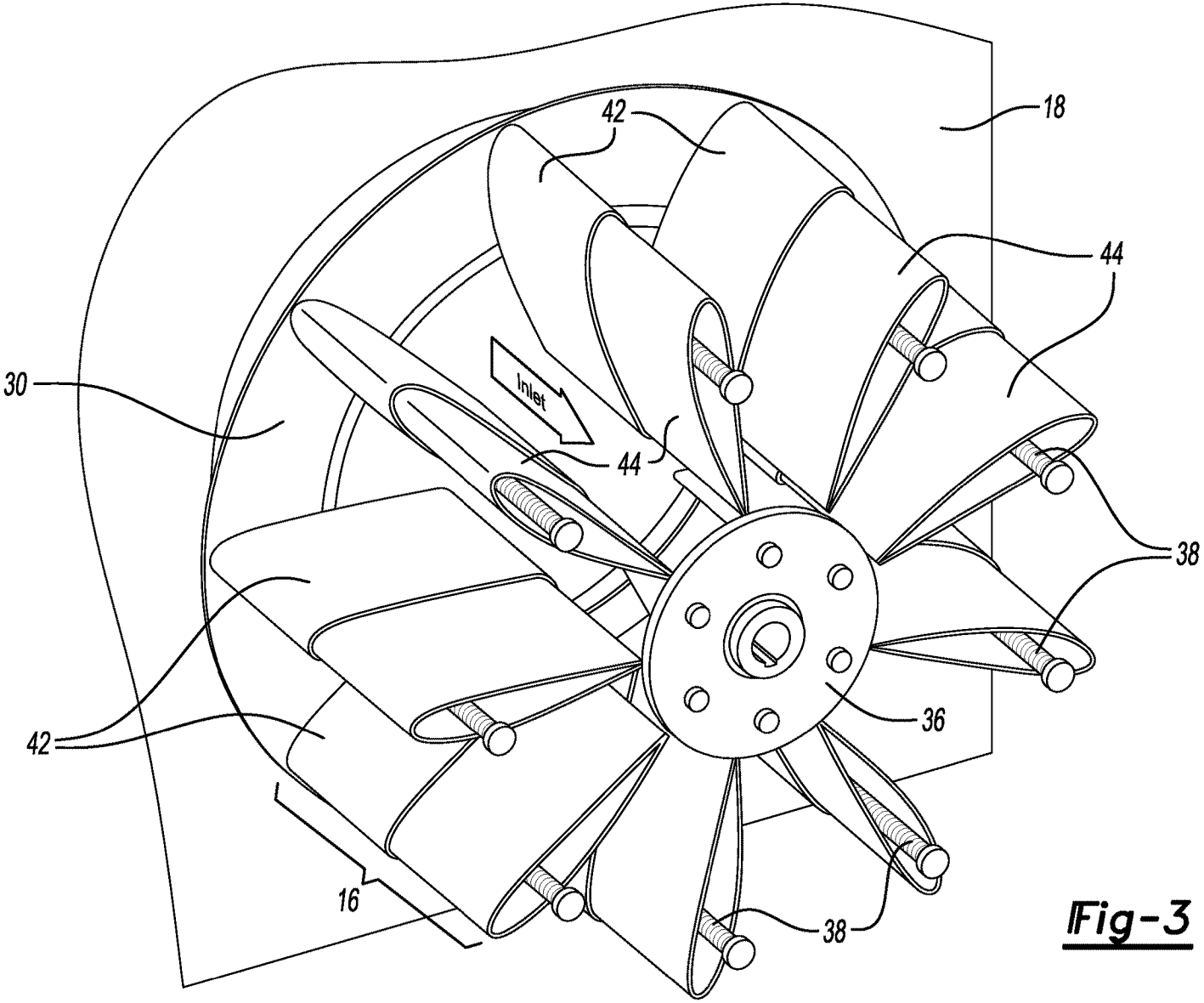
FIG. 3 is another perspective view of a portion of the centrifugal fan arrangement of FIG. 1.

Referring to FIGS. 1, 2, and 3, a centrifugal fan arrangement 10 includes support bracketry 12, a main motor assembly 14, a blade assembly 16, a face plate 18 that defines an inlet, a housing that defines an outlet (shown in fantom line), and one or more controllers 19. The support bracketry 12 defines a base 20 to which the main motor assembly 14 is anchored in known fashion.

The main motor assembly 14 includes a motor 22, a rotating shaft 24, and a slip ring 26. The rotating shaft 24 extends from the motor 22, and the slip ring 26 is carried by the rotating shaft 24 such that the slip ring 26 is between the blade assembly 16 and motor 22. The slip ring 26, as known in the art, is used to transmit signals from the one or more controllers 19 to components of the blade assembly 16, which are discussed in more detail below.

The blade assembly 16 includes a pair of parallel plates 28, 30, a mounting collar 32, a slidable plate 34, a mounting flange (with bushings) 36, a plurality of worm gear mechanisms (with threaded shafts) 38, a plurality of servo motors 40, a plurality of fixed fan blades 42, and a plurality of slidable fan blades 44. The mounting collar 32 is fixed to the rotating shaft 24 and mechanically fastened (e.g., bolted) to the plate 28. The plate 28 thus rotates with the rotating shaft 24. Opposite ends of the worm gear mechanisms 38 are mounted to the plates 28, 30 such that a distance between the plates 28, 30 remains unchanged. The plate 30 thus rotates with the rotating shaft 24. The mounting flange 36 is keyed to and slidably carried by the rotating shaft 24, and mechanically fastened (e.g., bolted) to the slidable plate 34. Moreover, the worm gear mechanisms 38 pass through the slidable plate 34 and corresponding fixed and slidable fan blades 42, 44. The worm gear mechanisms 38 also engage the slidable plate 34. The servo motors 40 are mounted to the plate 28. When actuated by the servo motors 40, the worm gear mechanisms 38 cause the slidable plate 34 to move toward and away from the parallel plate 30 depending on the direction of actuation.

The fixed fan blades 42 are distributed around the inlet defined by the face plate 18. They are also attached to and extend perpendicularly away from the plate 30 toward the slidable plate 34. The slidable fan blades 44 are distributed around the slidable plate 34. They are also attached to and extend perpendicularly away from the slidable plate 34 toward the plate 30. The fixed fan blades 42 are hollow such that each can receive a corresponding one of the slidable fan blades 44. As the slidable plate 34 moves toward the plate 30, the slidable fan blades 44 retract within the fixed fan blades 42, decreasing total fan blade surface area. As the slidable plate 34 moves away from the plate 30, the slidable fan blades 44 extend from the fixed fan blades 42, increasing total fan blade surface area. That is, the fixed and slidable fan blades 42, 44 form telescoping fan blades.

The one or more controllers 19 can thus generate commands for the servo motors 40 to move the slidable plate 34 toward or away from the plate 30 to cause the slidable fan blades 44 to retract into the fixed fan blades 42, or to cause the slidable fan blades 44 to extend from the fixed fan blades 42. Various input conditions may trigger such operation. For example, decreased air resistance from the fixed and slidable fan blades 42, 44 may be desirable in certain circumstances. The one or more controllers 19, as a result, may command the servo motors 40 to actuate the worm gear mechanisms 38 such that the slidable plate 34 moves toward the plate 30 to cause the slidable fan blades 44 to retract into the fixed fan blades 42.

The algorithms, methods, or processes disclosed herein can be deliverable to or implemented by a computer, controller, or processing device, which can include any dedicated electronic control unit or programmable electronic control unit. Similarly, the algorithms, methods, or processes can be stored as data and instructions executable by a computer or controller in many forms including, but not limited to, information permanently stored on non-writable storage media such as read only memory devices and information alterably stored on writeable storage media such as compact discs, random access memory devices, or other magnetic and optical media. The algorithms, methods, or processes can also be implemented in software executable objects. Alternatively, the algorithms, methods, or processes can be embodied in whole or in part using suitable hardware components, such as application specific integrated circuits, field-programmable gate arrays, state machines, or other hardware components or devices, or a combination of firmware, hardware, and software components.

While exemplary embodiments are described above, it is not intended that these embodiments describe all possible forms encompassed by the claims. Any suitable mechanism, for example, may be used to facilitate movement of the slidable plate 34 (and thus slidable fan blades 44) relative to the plate 30 (and thus fixed fan blades 42). An axially movable arm may be attached to a side of the slidable plate 34 opposite the slidable fan blades 34, and actuated to push the slidable plate 34 toward the plate 30 or to pull the slidable plate 34 away from the plate 30. Other configurations are also contemplated.

The words used in the specification are words of description rather than limitation, and it is understood that various changes may be made without departing from the spirit and scope of these disclosed materials. The words controller and controllers, and variations thereof for example, may be interchanged.

As previously described, the features of various embodiments may be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. These attributes may include, but are not limited to strength, durability, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and may be desirable for particular applications.

What is claimed is:

1. A fan comprising:

a housing defining a gas outlet for the fan;

a pair of opposing parallel plates disposed within the housing and being configured to rotate about an axis, one of the plates being configured to move toward and away from the other of the plates along the axis;

a plurality of first fan blades fixedly secured to and extending perpendicularly from a face of one of the plates; and a plurality of second fan blades fixedly secured to and extending perpendicularly from a face of the other of the plates, the faces being adjacent to each other, each of the second fan blades being configured to receive a corresponding one of the first fan blades as the one of the plates moves toward the other of the plates, and the second fan blades being arranged to surround a gas inlet for the fan that is in fluid communication with the gas outlet.

2. The fan of claim 1 further comprising a plurality of members connected between the plates such that each of the members passes through one of the second fan blades and a corresponding one of the first fan blades.

3. The fan of claim 2, wherein at least one of the members is a worm gear.

4. The fan of claim 1 further comprising a motor configured to drive the plates to rotate about the axis.

5. The fan of claim 1, wherein the plates are cylindrical plates.

6. A fan wheel comprising:

a pair of opposing parallel plates configured to rotate about an axis, one of the plates being configured to move toward and away from the other of the plates along the axis; and a plurality of telescoping fan blades having opposite ends respectively mounted to the plates such that the one of the plates moves away from the other of the plates as the telescoping fan blades extend and the one of the plates moves toward the other of the plates as the telescoping fan blades retract.

7. The fan wheel of claim 6 further comprising a plurality of members connected between the plates such that each of the members passes through one of the telescoping fan blades.

8. The fan wheel of claim 7, wherein at least one of the members is a worm gear.

9. The fan wheel of claim 6 further comprising a motor configured to drive the plates to rotate about the axis.

10. The fan wheel of claim 6, wherein the plates are cylindrical plates.

11. A fan comprising:

a housing defining a gas outlet; and the fan wheel of claim 6 disposed within the housing such that the plurality of telescoping fan blades defines a gas inlet in fluid communication with the gas outlet.

12. A system for controlling a fan comprising:

a fan wheel including opposite parallel plates and telescoping fan blades connected between the opposite parallel plates;

a worm gear having a threaded shaft connecting the opposite parallel plates;

at least one motor operatively arranged with the worm gear; and one or more controllers programmed to generate commands for the at least one motor to rotate the worm gear such that one of the plates moves toward the other of the plates to cause the telescoping fan blades to retract.

13. The method of claim 12, wherein the one or more controllers are further programmed to generate commands for the least one motor to rotate the worm gear such that one of the plates moves away from the other of the plates to cause the telescoping fan blades to extend.

* * * * *